US011220728B2

(12) United States Patent
Suzuki et al.

(10) Patent No.: US 11,220,728 B2
(45) Date of Patent: Jan. 11, 2022

(54) ALUMINUM ALLOY PIPE-SHAPED HOLLOW MATERIAL AND PIPING MATERIAL FOR HEAT EXCHANGER

(71) Applicants: UACJ Corporation, Tokyo (JP); UACJ Extrusion Corporation, Tokyo (JP)

(72) Inventors: Taichi Suzuki, Tokyo (JP); Naoki Yamashita, Tokyo (JP)

(73) Assignees: UACJ CORPORATION, Tokyo (JP); UACJ EXTRUSION CORPORATION, Tokyo (JP)

( * ) Notice: Subject to any disclaimer, the term of this patent is extended or adjusted under 35 U.S.C. 154(b) by 107 days.

(21) Appl. No.: 16/619,536

(22) PCT Filed: May 28, 2018

(86) PCT No.: PCT/JP2018/020282

§ 371 (c)(1),
(2) Date: Dec. 5, 2019

(87) PCT Pub. No.: WO2018/225552

PCT Pub. Date: Dec. 13, 2018

(65) Prior Publication Data

US 2020/0190635 A1 Jun. 18, 2020

(30) Foreign Application Priority Data

Jun. 7, 2017 (JP) ..... JP2017-112448

(51) Int. Cl.
*C22C 21/06* (2006.01)

(52) U.S. Cl.
CPC ..... *C22C 21/06* (2013.01); *Y10T 428/12292* (2015.01)

(58) Field of Classification Search
None
See application file for complete search history.

(56) References Cited

FOREIGN PATENT DOCUMENTS

JP 61-194145 A 8/1986
JP 2002-363677 A 12/2002
(Continued)

OTHER PUBLICATIONS

English International Search Report for corresponding PCT/JP2018/020282, dated Aug. 14, 2018 (1 page).
(Continued)

*Primary Examiner* — Daniel J. Schleis
(74) *Attorney, Agent, or Firm* — Flynn Thiel, P.C.

(57) ABSTRACT

An aluminum alloy pipe-shaped hollow material is produced by porthole extrusion. The aluminum alloy pipe-shaped hollow material includes an Al—Mg-based alloy containing Mg of 0.7 mass % or more and less than 2.5 mass %, and Ti of more than 0 mass % and 0.15 mass % or less, with the balance being Al and unavoidable impurities. A work hardening coefficient n-value is 0.25 or more and less than 0.43. The aluminum alloy pipe-shaped hollow material has an inner-surface ridged structure inside thereof, and an area ratio of the inner-surface ridged structure in a cross-section orthogonal to an extending direction of the aluminum alloy pipe-shaped hollow material is 1 to 30%. The present invention can provide an aluminum alloy pipe-shaped hollow material that is an aluminum alloy pipe-shaped hollow material of a 5000 series aluminum alloy produced by porthole extrusion and has excellent bending processability.

3 Claims, 2 Drawing Sheets

(56) References Cited

FOREIGN PATENT DOCUMENTS

| | | | |
|---|---|---|---|
| JP | 2003-226928 | A | 8/2003 |
| WO | 2016/159361 | A1 | 10/2016 |

OTHER PUBLICATIONS

Japanese International Search Report and Written Opinion for corresponding PCT/JP2018/020282, dated Aug. 14, 2018 (5 pages).

ALUMINUM ALLOY PIPE-SHAPED HOLLOW MATERIAL AND PIPING MATERIAL FOR HEAT EXCHANGER

TECHNICAL FIELD

The present invention relates to an aluminum alloy pipe-shaped hollow material used for piping or hose joints, for example, for a heat exchanger and having excellent bending processability and corrosion resistance.

BACKGROUND ART

Conventionally, as aluminum alloy pipe materials such as a piping material and a hose joint material for a heat exchanger, extruded pipes of 1000 series (pure aluminum series), 3000 series (Al—Mn series), 6000 series (Al—Mg—Si series) aluminum alloys have been used.

Examples of an extrusion method for manufacturing such extruded pipes include a mandrel extrusion and a porthole extrusion. In the mandrel extrusion, a stem connected to a mandrel is used to extrude a hollow billet into a circular pipe. In the porthole extrusion, extrusion is performed by using a hollow die including in combination a male die and a female die. The male die has port holes for dividing a material and a mandrel for forming a hollow portion. The female die has a chamber for welding together the divided materials in a manner surrounding the mandrel. However, the extruded pipe produced by the mandrel extrusion has problems in that, for example, uneven thickness is likely to occur and it is difficult to form a thin pipe. Thus, for aluminum alloy pipes such as a piping material and a hose joint material, it is preferable that extruded pipes be produced by the porthole extrusion.

For the conventional aluminum alloys described above, either of the extrusion methods can be used, and the porthole extrusion can be used to produce an extruded pipe having a predetermined shape. However, for example, 1000 series aluminum materials do not satisfy a requirement for high strength, 3000 series aluminum alloy materials may have a low corrosion resistance due to excessive precipitation of Mn along a welding line near a press joint, and 6000 series aluminum alloy materials have many restrictions in manufacturing processes because this series is of a heat treatment type. Thus, it is difficult to manufacture such extruded pipes from these aluminum materials due to the individual material characteristics.

Furthermore, bending is performed on a piping material, for example, in order to appropriately dispose and connect a heat exchanger. However, the conventional aluminum alloys described above have problems due to processing characteristics in that a bent portion does not uniformly deform during bending and tends to partially deform to be horizontally long in a cross-sectional view. From viewpoints of heat exchange efficiency and pressure loss of coolant, it is preferable that the amount of this deformation be reduced as much as possible.

In contrast, 5000 series (Al—Mg series) aluminum alloys have material characteristics excellent in strength, corrosion resistance, and processability, for example. However, the porthole extrusion cannot be usually used for 5000 series aluminum alloys because of high hardness thereof, and hollow pipes are extruded and formed usually by the mandrel extrusion (Patent Literatures 1 to 3).

Although some attempts to form 5000 series aluminum alloys by the porthole extrusion have been proposed, these attempts are not always satisfactory because a special die structure is required therein and there are restrictions in cross-sectional dimensions of extruded pipes, for example.

As a solution for processing characteristics, a method has been used for an inner-surface smooth pipe, in which drawing is performed to be hardened and tempered thereby hardening the pipe as appropriate before bending to reduce the amount of deformation.

Patent Literature 4 describes a method that enables porthole extrusion of 5000 series aluminum alloys excellent in processability and corrosion resistance by inventing chemical compositions, extrusion conditions, and the cross-sectional shape of an extruded pipe.

CITATION LIST

Patent Literature

[Patent Literature 1] Japanese Patent Publication S61-194145-A

[Patent Literature 2] Japanese Patent Publication 2002-363677-A

[Patent Literature 3] Japanese Patent Publication 2003-226928-A

[Patent Literature 4] PCT Publication WO2016/159361

SUMMARY OF INVENTION

Technical Problem

Patent Literature 4 relates to porthole extrusion smooth pipes of 5000 series aluminum alloys, and does not disclose means for solving a problem of a hollow material having an inner-surface ridged structure. For a hollow material having an inner-surface ridged structure such as ribs on its inner surface for improvement of heat exchange performance, drawing to be performed for an inner-surface smooth pipe cannot be performed, and it is difficult to increase strength thereof by drawing.

For piping or hose joints, for example, a product formed by bending an aluminum alloy pipe-shaped hollow material is used. However, such a porthole extrusion smooth pipe of an aluminum alloy has problems in that, when bending is performed thereon, a bent portion does not uniformly deform and tends to partially deform to be horizontally long in a cross-sectional view.

In view of this, it is an object of the present invention to provide an aluminum alloy pipe-shaped hollow material that is an aluminum alloy pipe-shaped hollow material of a 5000 series aluminum alloy produced by porthole extrusion and has excellent bending processability.

Solution to Problem

As a result of investigations on the above-described problems conducted over and over again, the inventors of the present invention found that controlling chemical compositions to set a work hardening coefficient n-value within a specified range enables work hardening to proceed appropriately in a bent portion when bending is performed thereon to achieve uniform deformation. The inventors also found that setting an area ratio of an inner-surface ridged structure within a specified range enables a load applied to a bent portion when bending is performed thereon to be distributed better than in the case of an inner-surface smooth pipe. Thus, the local deformation can be reduced, whereby the amount of deformation can be reduced. Thus, the inventors have completed the present invention.

Specifically, the present invention (1) provides an aluminum alloy pipe-shaped hollow material produced by porthole extrusion, the aluminum alloy pipe-shaped hollow material comprising an Al—Mg-based alloy containing Mg of 0.7 mass % or more and less than 2.5 mass %, and Ti of more than 0 mass % and 0.15 mass % or less, with the balance being Al and unavoidable impurities, in which a work hardening coefficient n-value is 0.25 or more and less than 0.43, and the aluminum alloy pipe-shaped hollow material has an inner-surface ridged structure inside thereof, and an area ratio of the inner-surface ridged structure in a cross-section orthogonal to an extending direction of the aluminum alloy pipe-shaped hollow material is 1 to 30%.

The present invention (2) provides the aluminum alloy pipe-shaped hollow material in (1) in which the area ratio of the inner-surface ridged structure is 4 to 30%. The present invention (3) provides a piping material that is a product formed with the aluminum alloy pipe-shaped hollow material in (1) or (2).

Advantageous Effects of Invention

The present invention can provide an aluminum alloy pipe-shaped hollow material that is an aluminum alloy pipe-shaped hollow material of a 5000 series aluminum alloy produced by porthole extrusion and has excellent bending processability.

DESCRIPTION OF EMBODIMENTS

Figure 1:
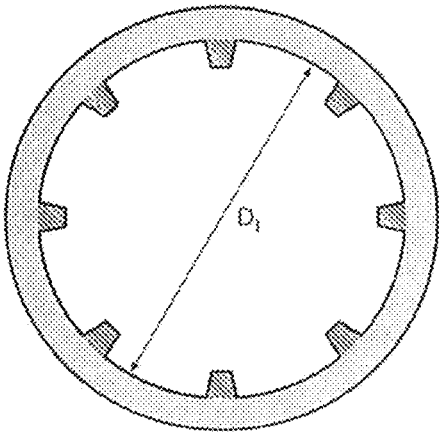
FIG. 1 is a schematic sectional view illustrating an embodiment of an aluminum alloy pipe-shaped hollow material having inner surface ribs.

An aluminum alloy pipe-shaped hollow material according to the present invention is an aluminum alloy pipe-shaped hollow material produced by porthole extrusion, the aluminum alloy pipe-shaped hollow material including an Al—Mg-based alloy containing Mg of 0.7 mass % or more and less than 2.5 mass %, and Ti of more than 0 mass % and 0.15 mass % or less, with the balance being Al and unavoidable impurities, in which a work hardening coefficient n-value is 0.25 or more and less than 0.43, and the aluminum alloy pipe-shaped hollow material has an inner-surface ridged structure inside thereof, and an area ratio of the inner-surface ridged structure in a cross-section orthogonal to an extending direction of the aluminum alloy pipe-shaped hollow material is 1 to 30%.

The aluminum alloy pipe-shaped hollow material according to the present invention is an aluminum alloy pipe-shaped hollow material produced by performing porthole extrusion on a billet to be extruded made of an aluminum alloy having a predetermined composition, that is, a porthole extrusion pipe-shaped hollow material made of the aluminum alloy.

The aluminum alloy that forms the aluminum alloy pipe-shaped hollow material of the present invention is an Al—Mg-based alloy that contains predetermined amounts of Mg and Ti, with the balance being Al and unavoidable impurities.

Mg functions to increase strength. The Mg content in the aluminum alloy of the aluminum alloy pipe-shaped hollow material of the present invention is 0.7 mass % or more and less than 2.5 mass %, and preferably 0.7 to 1.3 mass %. By setting the Mg content in the aluminum alloy within the above-described range, a strength required as a piping material, for example, can be achieved, and also the aluminum alloy pipe-shaped hollow material can be manufactured by porthole extrusion because hot deformation resistance thereof during extrusion does not excessively increase. Furthermore, because of the presence of Mg thus contained, the work hardening coefficient n-value is larger than those of 1000 series and 3000 series aluminum alloys, which enables work hardening to proceed appropriately in a bent portion when bending is performed thereon to achieve uniform deformation. Thus, the hollow material has excellent processability. In contrast, if the Mg content in the aluminum alloy is less than the above-described range, the strength becomes equivalent to those of 1000 series aluminum alloys, and thus a strength ordinarily required to a piping material cannot be achieved. If the Mg content exceeds the above-described range, the extrusion pressure during porthole extrusion increases, which makes extrusion difficult.

Ti functions as a structure refiner for achieving a finer cast structure, for example. The Ti content in the aluminum alloy of the aluminum alloy pipe-shaped hollow material of the present invention is more than 0 mass % and 0.15 mass % or less, and preferably 0.01 to 0.05 mass %. If the Ti content in the aluminum alloy is 0 mass %, that is, if the aluminum alloy does not contain Ti, the cast structure becomes coarse and heterogeneous like feathery crystals, and thus coarse grains may be partially formed in the structure of the extruded pipe-shaped hollow material and the grain structure may become heterogeneous, for example, which makes it difficult to achieve uniform deformation during bending. If the Ti content exceeds the above-described range, a giant compound may be formed and a surface defect, for example, may occur during extrusion, or a crack or a split may be more likely to occur from the giant compound as a starting point during bending, for example, which may adversely affect the processability as a product.

The aluminum alloy of the aluminum alloy pipe-shaped hollow material of the present invention may contain, in addition to Mg and Ti, one type or two or more types out of Si, Fe, Cu, Mn, Cr, and Zn if needed. In this case, the contents of the individual elements in the aluminum alloy are Si: 0.20 mass % or less, Fe: 0.20 mass % or less, Cu: 0.05 mass % or less, Mn: 0.10 mass % or less, Cr: 0.10 mass % or less, and Zn: 0.10 mass % or less.

If the Si content in the aluminum alloy exceeds 0.20 mass %, a $Mg_2Si$ compound is excessively formed, whereby the corrosion resistance is reduced. If the Fe content in the aluminum alloy exceeds 0.20 mass %, an $Al_3Fe$ compound is excessively precipitated, whereby the corrosion resistance is reduced. If the Cu content in the aluminum alloy exceeds 0.05 mass %, grain boundary corrosion susceptibility increases, and accordingly the corrosion resistance decreases.

Mn tends to be precipitated during extrusion. If the Mn content in the aluminum alloy exceeds 0.10%, when excessive precipitation thereof proceeds in a welded portion during porthole extrusion, a potential difference is generated between the welded portion and a general portion. The potential difference causes preferential corrosion along the welded portion to lead to penetration at early stage, thereby impairing the corrosion resistance. However, the aluminum alloy pipe-shaped hollow material of the present invention does not contain Mn or contains Mn at a content not exceeding 0.1 mass %, also contains a predetermined amount of Mg, and thus preferential corrosion does not occur therein because precipitation of Mg does not proceed in the Al—Mg alloy during extrusion. Furthermore, the aluminum alloy pipe-shaped hollow material has corrosion resistance excellent in salt water environments because it is of a 5000 series aluminum alloy.

If the Cr content in the aluminum alloy exceeds 0.10 mass %, a heterogeneous grain structure is obtained in which a recrystallized structure and a fibrous structure are present in a mixed manner because Cr suppresses recrystallization after extrusion, which makes it difficult to achieve uniform deformation during processing. If the Zn content in the aluminum alloy exceeds 0.10 mass %, whole-surface corrosion proceeds and the amount of corrosion increases, whereby the corrosion resistance is reduced.

The aluminum alloy of the aluminum alloy pipe-shaped hollow material of the present invention may contain, in addition to Si, Fe, Cu, Mn, Cr and Zn described above, other impurities within a range that does not affect the effects of the present invention, and the content of each of the impurities may be 0.05 mass % or less, and the total content thereof may be 0.15 mass % or less.

The work hardening coefficient n-value of the aluminum alloy pipe-shaped hollow material of the present invention is 0.25 or more and less than 0.43. If the work hardening coefficient n-value of the aluminum alloy pipe-shaped hollow material is less than 0.25, which is a value equivalent to those of conventional 1000 series and 3000 series aluminum alloys, the amount of deformation of a bent portion when bending is performed increases because work hardening in the bent portion is insufficient. If the work hardening coefficient n-value is 0.43 or more, work hardening excessively proceeds, which makes it difficult to obtain a predetermined bent shape by an ordinary bending method.

The aluminum alloy pipe-shaped hollow material of the present invention has the inner-surface ridged structure inside thereof. This inner-surface ridged structure is formed when porthole extrusion is performed. In the aluminum alloy pipe-shaped hollow material of the present invention, the area ratio of the inner-surface ridged structure in a cross-section orthogonal to the extending direction of the aluminum alloy pipe-shaped hollow material is 1 to 30%, and preferably 4 to 25%. By setting the area ratio of the inner-surface ridged structure of the aluminum alloy pipe-shaped hollow material within the above-described range, a load applied to a bent portion when bending is performed thereon is distributed better than in the case of an inner-surface smooth pipe, whereby local deformation is reduced, and thus the amount of deformation can be reduced. In contrast, if the area ratio of the inner-surface ridged structure of the aluminum alloy pipe-shaped hollow material is less than the above-described range, the effect of distributing the load applied to the bent portion cannot be obtained, and thus the bent portion is more likely to deform to be horizontally long in a cross-sectional view in a flattened manner as in the case of a smooth pipe. If the area ratio exceeds the above-described range, a load required when bending is performed increases, which makes it difficult to obtain a predetermined bent shape by an ordinary bending method.

In the present invention, the inner-surface ridged structure means ribs or fins formed on a pipe inner surface of a pipe shape as a base (i.e., a pipe shape of an inner-surface smooth pipe), or partition portions inside the pipe shape as a base.

An embodiment illustrated in FIG. 1 is of an aluminum alloy pipe-shaped hollow material having a pipe inner surface on which ribs or fins, the shapes of which are rectangular or trapezoidal in a cross-section orthogonal to the extending direction of the aluminum alloy pipe-shaped hollow material, are formed in order to increase the surface area of the inner surface for the purpose of improving heat exchange performance. In the embodiment illustrated in FIG. 1, the ribs or fins formed on such a pipe inner surface constitute an inner-surface ridged structure.

Figure 2:
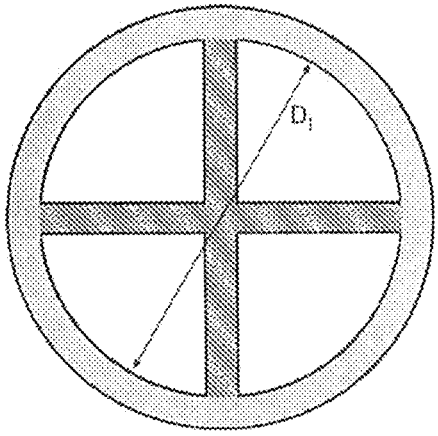
FIG. 2 is a schematic sectional view illustrating an embodiment of the aluminum alloy pipe-shaped hollow material having partitions.
Figure 3:
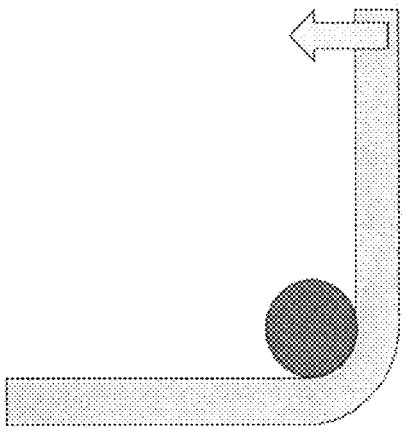
FIG. 3 is a diagram illustrating a method of bending in Examples and Comparative Examples.

An embodiment illustrated in FIG. 2 is of an aluminum alloy pipe-shaped hollow material having partitions formed inside the pipe in such a shape that the inside of the pipe is divided into a plurality of sections in a cross-section orthogonal to the extending direction of the aluminum alloy pipe-shaped hollow material in order to form a plurality of flow passages therein for the purpose of diverting coolant flowing inside. In the embodiment illustrated in FIG. 2, such partitions formed inside the pipe constitute an inner-surface ridged structure. In the embodiment illustrated in FIG. 2, four partition walls are formed from the center of the pipe such that the inside of the pipe is divided into quarters.

In the present invention, the area ratio of the inner-surface ridged structure is an area ratio of the inner-surface ridged structure in a cross-section orthogonal to the extending direction of the aluminum alloy pipe-shaped hollow material. The area ratio of the inner-surface ridged structure is a value, expressed in percentage, that is obtained by using the inner diameter (reference sign $D_I$ in FIG. 1 and FIG. 2) of the pipe shape as a base in a cross-section orthogonal to the extending direction of the aluminum alloy pipe-shaped hollow material to calculate the cross-sectional area (A) ($A=(\pi\times(D_I/2)^2)$ of the inner surface of the pipe shape as a base, and then dividing the cross-sectional area (B) of the inner-surface ridged structure by the cross-sectional area (A) (Formula (1) below).

$$\text{Area ratio (\%) of Inner-surface ridged structure}=(B/A)\times 100 \quad (1)$$

Herein, the cross-sectional area (A) of the inner surface of the pipe shape as a base translates into the cross-sectional area of the inside of a pipe corresponding to the inner-surface smooth pipe when the pipe is assumed to be an inner-surface smooth pipe.

The thickness of the aluminum alloy pipe-shaped hollow material of the present invention is preferably 0.5 to 2.5 mm, and more preferably 1.0 to 2.0 mm.

The aluminum alloy pipe-shaped hollow material of the present invention is made of a 5000 series aluminum alloy and has a work hardening coefficient n-value within a specified range, and thus work hardening can proceed appropriately in a bent portion when bending is performed thereon to achieve uniform deformation. The aluminum alloy pipe-shaped hollow material also has an area ratio of an inner-surface ridged structure within a specified range, and thus a load applied to a bent portion when bending is performed thereon can be distributed better than the case of an inner-surface smooth pipe to reduce local deformation, whereby the amount of deformation can be reduced. Thus, the aluminum alloy pipe-shaped hollow material of the present invention can be used satisfactorily as, for example, a piping material for a heat exchanger on which bending is required to be performed and in which high strength is required.

The piping material for a heat exchanger of the present invention is a piping material for a heat exchanger that is a product formed with the aluminum alloy pipe-shaped hollow material of the present invention.

Hereinafter, Examples will be described for specifically describing the present invention. However, the present invention is not limited to Examples described below.

EXAMPLES

Examples and Comparative Examples

Aluminum alloys A to I having chemical compositions given in Table 1 were melted, and were casted into ingots each in a billet shape having a diameter of 90 mm by continuous casting. For comparison, a 3003 alloy for a conventional piping material was produced as an alloy J at the same time. The obtained billets were homogenized at 500° C. for eight hours, and were then extruded at a temperature of 450° C. into pipe-shaped hollow materials (test materials No. 1 to 16) each having any one of shapes given in Table 2. An example of a cross-sectional shape is illustrated in each of FIG. 1 and FIG. 2. No. 1 to 7 and 10 to 14 are shapes each having ribs formed on the corresponding inner surface as illustrated in FIG. 1; No. 8, 9, and 16 are shapes each having partitions formed on the corresponding inner surface as illustrated in FIG. 2; and No. 15 is a conventional shape (inner-surface smooth pipe). For each shape, the cross-sectional area of the inside of a pipe corresponding to the inner-surface smooth pipe was calculated based on the corresponding inner diameter $D_I$, and the ratio of the area of the hatched inner-surface ridged structure to the cross-sectional area was given as an area ratio.

For each extruded test material, a mechanical property, a work hardening coefficient n-value, and the deformation rate at the time when bending was performed were evaluated according to the methods described below. The results are given in Table 3.

TABLE 1

(mass %)

| | Alloy Name | Si | Fe | Cu | Mn | Mg | Cr | Zn | Ti | Al |
|---|---|---|---|---|---|---|---|---|---|---|
| Example | A | 0.11 | 0.15 | — | — | 0.73 | — | — | 0.01 | bal. |
| Example | B | 0.09 | 0.18 | — | — | 1.04 | — | — | 0.01 | bal. |
| Example | C | 0.12 | 0.14 | — | — | 1.27 | — | — | 0.01 | bal. |
| Example | D | 0.08 | 0.19 | — | — | 1.33 | — | — | 0.01 | bal. |
| Example | E | 0.09 | 0.16 | — | — | 2.48 | — | — | 0.01 | bal. |
| Comparative Example | F | 0.13 | 0.18 | — | — | 0.65 | — | — | 0.01 | bal. |
| Comparative Example | G | 0.11 | 0.17 | — | — | 2.57 | — | — | 0.01 | bal. |
| Comparative Example | H | 0.12 | 0.12 | — | — | 1.28 | — | — | — | bal. |
| Comparative Example | I | 0.10 | 0.14 | — | — | 1.26 | — | — | 0.17 | bal. |
| Comparative Example | J | 0.07 | 0.21 | 0.07 | 1.11 | — | — | — | 0.01 | bal. |

TABLE 2

| | Shape name | Pipe outer diameter mm | Pipe inner diameter mm | Thickness mm | Cross-sectional area corresponding to inner pipe $mm^2$ | Area of inner-surface ridged structure $mm^2$ | Area ratio of inner-surface ridged structure % |
|---|---|---|---|---|---|---|---|
| Example | I | 25 | 22 | 1.5 | 380 | 5.5 | 1.4 |
| Example | II | 25 | 22 | 1.5 | 380 | 17 | 4.3 |
| Example | III | 20 | 18 | 1.0 | 254 | 32 | 12.6 |
| Example | IV | 25 | 22 | 1.5 | 380 | 51 | 13.5 |
| Example | V | 15 | 13 | 1.0 | 133 | 32 | 24.0 |
| Comparative Example | VI | 25 | 23 | 1.0 | 415 | 0 | 0.0 |
| Comparative Example | VII | 15 | 13 | 1.0 | 133 | 44 | 32.8 |

TABLE 3

| | Sample | Alloy name | Shape name | Area ratio % | Tensile strength MPa | Yield strength MPa | Elongation % | n-value | Flattening % | Pass/Fail |
|---|---|---|---|---|---|---|---|---|---|---|
| Example | No. 1 | A | I | 1.4 | 88 | 36 | 28 | 0.26 | 68 | ○ |
| Example | No. 2 | A | II | 4.3 | 89 | 38 | 27 | 0.26 | 76 | ◎ |
| Example | No. 3 | B | II | 4.3 | 112 | 45 | 27 | 0.28 | 77 | ◎ |
| Example | No. 4 | C | II | 4.3 | 134 | 48 | 29 | 0.31 | 79 | ◎ |

TABLE 3-continued

| | Sample | Alloy name | Shape name | Area ratio % | Tensile strength MPa | Yield strength MPa | Elongation % | n-value | Flattening % | Pass/Fail |
|---|---|---|---|---|---|---|---|---|---|---|
| Example | No. 5 | D | II | 4.3 | 140 | 52 | 28 | 0.34 | 80 | ◎ |
| Example | No. 6 | E | II | 4.3 | 202 | 74 | 30 | 0.40 | 82 | ◎ |
| Example | No. 7 | B | III | 12.6 | 111 | 44 | 28 | 0.28 | 80 | ◎ |
| Example | No. 8 | B | IV | 13.5 | 114 | 45 | 27 | 0.27 | 84 | ◎ |
| Example | No. 9 | C | V | 24.0 | 131 | 50 | 29 | 0.32 | 87 | ◎ |
| Comparative Example | No. 10 | F | II | 4.3 | 79 | 31 | 29 | 0.23 | 50 | X |
| Comparative Example | No. 11 | G | II | 4.3 | 221 | 80 | 32 | 0.45 | Failed to be bent 90° | X |
| Comparative Example | No. 12 | H | II | 4.3 | 131 | 48 | 29 | 0.30 | 61 | X |
| Comparative Example | No. 13 | I | II | 4.3 | 132 | 46 | 28 | 0.31 | Crack occurred at bent portion | X |
| Comparative Example | No. 14 | J | II | 4.3 | 110 | 33 | 43 | 0.22 | 52 | X |
| Comparative Example | No. 15 | C | VI | 0.0 | 131 | 47 | 29 | 0.31 | 55 | X |
| Comparative Example | No. 16 | C | VII | 32.8 | 132 | 48 | 28 | 0.31 | Failed to be bent 90° | X |

<Mechanical Property>

From a central portion of each test material in the lengthwise direction, a sample was cut to produce a test piece, tensile testing was conducted according to JIS Z-2241 to evaluate a mechanical property.

<Work Hardening Coefficient n-Value>

Based on a stress-strain diagram obtained from the tensile testing, a true stress and a true strain were determined, and the work hardening coefficient n-value was calculated by the following formula.

$n=\ln\sigma/\ln\varepsilon$ (where, $\sigma$:true stress, $\varepsilon$:true strain)

<The Deformation Rate at the Time of Bending>

Figure 4:
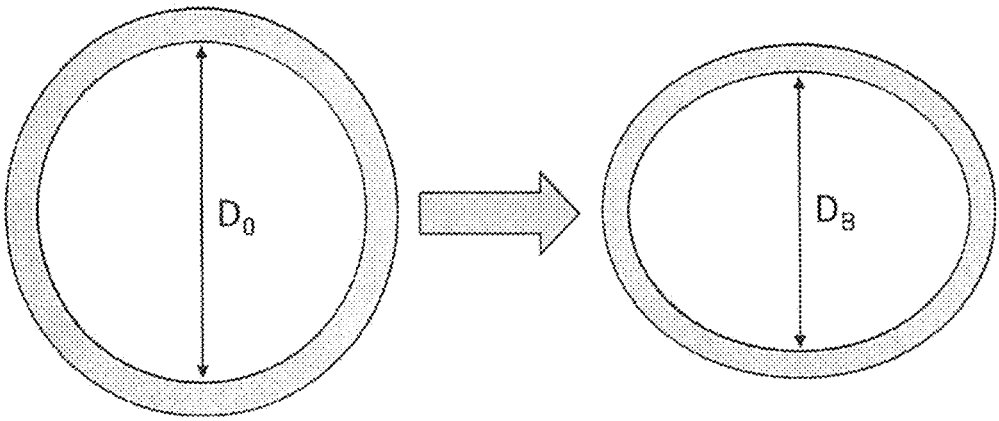
FIG. 4 is a diagram illustrating $D_0$ and $D_B$ for calculating a deformation rate.

From a central portion of each test material in the lengthwise direction, a sample having a length of 500 mm was cut, and bending was performed on this test piece at the center thereof. A method of processing is illustrated in FIG. 4. The processing was performed at an inner-surface bending R=40 (bending radius=40 mm), a bending angle=90°, a bending force of 2,000 kgf. A central portion of each processed test piece in the lengthwise direction was cut, the short diameter $D_B$ out of inner diameters after bending was measured from the cross-section as illustrated in FIG. 5, and was divided by the inner diameter Do before bending to calculate the deformation rate (deformation rate (%)=$(D_B/D_0)\times100$). A sample the deformation rate of which was 65% or more was determined to be excellent (O), and a sample the flattening of which was 75% or more was determined to be more excellent (◎).

As indicated in Table 3, the test material 1 (alloy A, shape I) of Example had a deformation rate of 65% or more when bending was performed thereon, and thus had such excellent processability that the amount of deformation at the time of bending was small. The test materials 2 to 9 (alloys A to E, shapes II to V) of Examples had deformation rates of 75% or more when bending was performed thereon, and thus had more excellent bending processability.

In contrast, the Mg content of the test material 10 of Comparative Example was low, and the n-value of the test material 14 of Comparative Example was small because it was of a 3000 series alloy. Thus, these test materials were determined to be failed because work hardening was insufficient during bending and bent portions thereof were significantly deformed.

The n-value of the test material 11 of Comparative Example was large because the Mg content thereof was high, and work hardening excessively proceeded and a load required for bending accordingly increased. Thus, 90° bending failed to be performed thereon at the present bending testing.

Because the test material 12 of Comparative Example did not contain Ti, coarse grains were formed partially and deformation thereof during bending was non-uniform. Thus, a bent portion thereof was deformed significantly, and it was determined to be failed.

Because the Ti content of the test material 13 of Comparative Example was high, a giant compound was formed. A crack occurred from the giant compound as a starting point during bending, and thus 90° bending failed to be performed thereon.

Because the test material 15 of Comparative Example was a smooth pipe without an inner-surface ridged structure, the effect of distributing a load applied to a bent portion thereof failed to be obtained, and the bent portion was deformed significantly. Thus, it was determined to be failed.

Because the area ratio of the inner-surface ridged structure of the test material 16 of Comparative Example was 30% or more, a load required during bending was high. Thus, 90° bending failed to be performed thereon at the present bending testing.

The invention claimed is:

1. An aluminum alloy pipe-shaped hollow material produced by porthole extrusion, the aluminum alloy pipe-shaped hollow material comprising an Al—Mg-based alloy containing Mg of 0.7 mass % or more and less than 2.5 mass %, and Ti of more than 0 mass % and 0.15 mass % or less, with the balance being Al and unavoidable impurities, wherein a work hardening coefficient n-value is 0.25 or more and less than 0.43, and the aluminum alloy pipe-shaped hollow material having a pipe portion, a longitudinal axis, a hollow portion, and a ridged structure or partition portion formed on an inner surface of the pipe portion, the pipe portion being a base for the ridged structure or partition portion, the ridged structure or the partition portion having an area (B) measured in cross-section orthogonal to the longitudinal axis, the hollow portion having an area (A) defined by the formula $\pi\times(D_I/2)^2$ where $D_I$ is an inner diameter of the pipe-shaped hollow material measured in cross-section orthogonal to the longitudinal axis, an area ratio percentage of (B)/(A)×100 being between 1% and 30%.

2. The aluminum alloy pipe-shaped hollow material according to claim 1, wherein the area ratio percentage is between 4% and 30%.

3. A piping material for a heat exchanger, the piping material being a product formed with the aluminum alloy pipe-shaped hollow material according to claim 1.

* * * * *